US005588321A

United States Patent [19]

Snyder et al.

[11] Patent Number: 5,588,321

[45] Date of Patent: Dec. 31, 1996

[54] SEGMENTED SCRIBING ROLLER FOR REFINING THE DOMAIN STRUCTURE OF ELECTRICAL STEELS BY LOCAL MECHANICAL DEFORMATION

[75] Inventors: Ralph E. Snyder, Export; Dominic A. Sorace, Sarver; James G. Benford, Pittsburgh, all of Pa.

[73] Assignee: Allegheny Ludlum Corporation, Pittsburgh, Pa.

[21] Appl. No.: 494,475

[22] Filed: Jun. 26, 1995

Related U.S. Application Data

[62] Division of Ser. No. 378,891, Jan. 25, 1995, Pat. No. 5,463,889.

[51] Int. Cl.[6] ..... B21B 1/22

[52] U.S. Cl. ..... 72/366.2; 148/111

[58] Field of Search ..... 72/194, 197, 199, 72/265.2, 366.2; 148/111, 112, 113, 308; 492/4, 5, 30, 39

[56] References Cited

U.S. PATENT DOCUMENTS

| | | | |
|---|---|---|---|
| 3,095,634 | 7/1963 | Williams et al. | 492/4 |
| 3,217,387 | 11/1965 | Strindlund | 492/39 |
| 3,253,323 | 5/1966 | Saueressig | 492/39 |
| 3,543,366 | 12/1970 | Collet | 492/4 |
| 4,533,409 | 8/1985 | Benford | 148/11 |
| 4,614,632 | 9/1986 | Kezuka et al. | 492/30 |
| 4,711,113 | 12/1987 | Benford | 72/197 |
| 4,742,706 | 5/1988 | Sasaki et al. | 72/241 |
| 4,770,720 | 9/1988 | Kobayashi et al. | 148/111 |
| 5,080,326 | 1/1992 | Price et al. | 266/103 |
| 5,123,977 | 6/1992 | Price et al. | 148/111 |
| 5,397,402 | 3/1995 | Benford | 148/111 |

FOREIGN PATENT DOCUMENTS

| | | | |
|---|---|---|---|
| 2356243 | 1/1975 | Germany | 72/197 |

*Primary Examiner*—Lowell A. Larson
*Assistant Examiner*—Thomas C. Schoeffler
*Attorney, Agent, or Firm*—Patrick J. Viccaro

[57] ABSTRACT

A method and apparatus are provided for refining the domain wall spacing of a grain-oriented silicon steel sheet by mechanical scribing using a solid anvil roll and a scribing roller including scribing segments arranged side by side along an arbor. The arbor carries inflatable bladder ribs along the length of the arbor to provide uniform contact pressure exerted by scribing surfaces of the strip.

7 Claims, 5 Drawing Sheets

SEGMENTED SCRIBING ROLLER FOR REFINING THE DOMAIN STRUCTURE OF ELECTRICAL STEELS BY LOCAL MECHANICAL DEFORMATION

CROSS REFERENCE TO RELATED APPLICATIONS

This is a division of application Ser. No. 08/378,891, filed Jan. 25, 1995, now U.S. Pat. No. 5,463,889.

This application is related to U.S. patent applications (RL-1610) Ser. No. 08/378,108, filed Jan. 25, 1995, which is a continuation of (RL-1530) Ser. No. 07/977,584, filed Nov. 17, 1992, now abandoned; (BR-1608) Ser. No. 08/378,893, filed Jan. 25, 1995, which is a continuation of (BR-1545) Ser. No. 07/977,359, filed Nov. 17, 1992, now abandoned; (LB-1611) Ser. No. 08/379,415, filed Jan. 27, 1995, which is a division of (LB-1487) Ser. No. 07/977,595, filed Nov. 17, 1992; and (RL-1512) U.S. Pat. No. 5,350,464, issued Sep. 27, 1994; and (RL-1503) U.S. Pat. No. 5,312,496, issued May 17, 1994.

BACKGROUND OF THE INVENTION

1. Field of the Invention

This invention relates to a method and apparatus for improving core loss by refining the magnetic domain wall spacing of electrical sheet or strip product. More particularly, this invention relates to refining final texture annealed grain-oriented silicon steels with a segmented scribing roller to cause uniform local mechanical deformation across the width of the sheet or strip product while supported by an anvil roll.

2. Description of the Prior Art

Grain-oriented silicon steel is conventionally used in electrical applications, such as power transformers, distribution transformers, generators, and the like. The steel's ability to permit cyclic reversals of the applied magnetic field with only limited energy loss is a most important property. A reduction of this loss, which is termed "core loss", is highly desirable in the aforesaid electrical applications.

In the manufacture of grain-oriented silicon steel, it is known that the Goss secondary recrystallization texture, (110)[001] in terms of Miller's indices, results in improved magnetic properties, particularly permeability and core loss over non-oriented silicon steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon; casting the melt; hot rolling; cold rolling the steel to final gauge typically of 7 or 9 mils, and up to 14 mils with intermediate annealing when two or more cold rolling are used or no intermediate annealing for certain high permeability silicon steels; decarburizing the steel; applying a refractory oxide base coating, such as a magnesium oxide, to the steel; and final texture annealing the steel at elevated temperatures in order to produce the desired secondary recrystallization and purification treatment to remove impurities such as nitrogen and sulfur. The development of the cube-on-edge orientation is dependent upon the mechanism of secondary recrystallization wherein, during recrystallization, secondary cube-on-edge oriented grains are preferentially grown at the expense of primary grains having a different and undesirable orientation.

As used herein, "sheet" and "strip" are used interchangeably and mean the same unless otherwise specified.

It is also known that through the efforts of many prior art workers, cube-on-edge grain-oriented silicon steels generally fall into two basic categories: first, regular or conventional grain-oriented silicon steel; and second, high permeability, grain-oriented silicon steel. Regular, grain-oriented silicon steel is generally characterized by a permeability of less than 1870 at 10 Oersteds. High permeability, grain-oriented silicon steels are characterized by higher permeabilities which may be the result of composition changes alone or together with process changes. For example, high permeability silicon steels may contain nitrides, sulfides, selenides, and/or borides which contribute to the particles of the inhibition system which is essential to the secondary recrystallization process for the steel. Furthermore, such high permeability silicon steels generally undergo greater cold reduction to final gauge than regular grain oriented steels. A heavy final cold reduction on the order of greater than 80% is generally made in order to facilitate the high permeability grain orientation. While such higher permeability materials are desirable, such materials tend to produce larger magnetic domains than conventional material. Generally, larger domains are detrimental to core loss.

It is known that one of the ways that domain size and thereby core loss values of electrical steels may be reduced occurs when the steel is subjected to any one of various practices designed to induce localized strains in the surface of the steel. Such practices may be generally referred to as "domain refining by scribing" and are performed after the final high temperature annealing operation. If the steel is scribed after the final texture annealing, a localized stress state in the texture-annealed sheet is induced so that the domain wall spacing is reduced. These disturbances typically are relatively narrow, straight line patterns, or scribes, generally spaced at regular intervals. The scribe lines are substantially transverse to the rolling direction and typically are applied to only one side of the steel.

In fabricating electrical steels into transformers, the steel inevitably suffers some deterioration in core loss quality due to cutting, bending, and construction of cores during fabrication, all of which impart undesirable stresses in the material. During fabrication incidental to the production of stacked core transformers and, more particularly, power transformers in the United States, the deterioration in core loss quality due to fabrication is not so severe that a stress relief anneal, typically about 1475° F. (801° C.), is essential to restore properties. For such end uses, there is a need for a flat, domain-refined silicon steel which need not be subjected to stress relief annealing. In other words, the scribed steel used for this purpose does not have to possess domain refinement which is heat resistant.

However, during the fabrication incidental to the production of most distribution transformers in the United States, the steel strip is cut and subjected to various bending and shaping operations which produce more working stresses in the steel than in the case of power transformers. In such instances, it is necessary and conventional for manufacturers to stress relief anneal the product to relieve such stresses.

During stress relief anneal, it has been found that the beneficial effect on core loss resulting from some scribing techniques, such as mechanical and thermal scribing, are lost. For such end uses, it is required and desired that the product exhibit heat resistant domain refinement in order to retain the improvements in core loss values resulting from scribing.

In referring now to certain prior teaching, U.S. Pat. No. 4,533,409, issued Dec. 19, 1984 and U.S. Pat. No. 4,711,113, issued Dec. 8, 1987, disclose a method and apparatus for scribing a grain-oriented silicon steel to refine the grain structure by passing the cold strip through a roll pass defined by an anvil roll and scribing roll. The surface of the scribing roll is provided with a plurality of projections extending along and generally parallel to the roll axis. The anvil roll is typically constructed from a material that is relatively more elastic than the material from which the scribing roll is constructed. Preferably, the scribing roll is constructed from steel and the anvil roll is constructed from rubber. The process described in U.S. Pat. No. 4,711,113, may be performed before or after stress relief annealing but the domain refinement achieved is not maintained through the usual stress relief annealing temperatures.

U.S. Pat. No. 4,742,706, issued May 10, 1988, discloses an apparatus for imparting strain to a moving steel sheet at linear spaced-apart, deformation regions. The apparatus includes a strain imparting roll having a plurality of projections as in the above described U.S. Pat. No. 4,711,113, but where the projections are formed on a spiral relative to the axis of rotation of the roll, the apparatus of the '706 patent also includes a press roll, a plurality of back-up rolls and a fluid pressure cylinder interconnected so as to control pressure against the press roll.

U.S. Pat. No. 4,770,720, issued Sep. 13, 1988, discloses a cold deformation technique wherein final texture annealed grain oriented silicon steel at as low as room temperature, and at as high as from 50° to 500° C. (122° to 932° F.) is subjected to local loading, at a mean load of 90 to 220 kg/mm$^2$ to (127,000 to 325,000 PSI) to form spaced apart grooves. The sheet must then be annealed at 750° C. (1380° F.) or more so that fine recrystallized grains are formed to divide the magnetic domains and improve core loss values which survive subsequent stress relief annealing.

In U.S. Pat. No. 5,080,326, issued Jan. 14, 1992 and U.S. Pat. No. 5,123,977, issued Jun. 23, 1992 and assigned to the same assignee of this patent application, a hot deformation technique is disclosed wherein the steel sheet is heated to a temperature in the range of 1200° F. to 1500° F. (648° C. to 816° C.) and while in this state it is locally hot deformed to facilitate the development of localized fine recrystallized grains in the vicinity of the areas of localized deformations to effect heat resistant domain refinement and core loss.

In pending U.S. application (LB-1487) Ser. No. 07/977,595, filed Nov. 17, 1992, and (RL-1512) U.S. Pat. No. 5,350,464, issued Sep. 27, 1994, both of which are assigned to the same Assignee of this patent application, the use of a series of short body scribing rolls is disclosed, the rolls being arranged in at least two rows in a staggered pattern so as to scribe the entire transverse width of the strip. In one form the strip scribing projections of the scribing rolls are arrayed co-axially with the rolls and in another form they take a herringbone pattern.

In pending U.S. application (RL-1610) Ser. No. 08/378,108, filed Jan. 25, 1995, which is a continuation of (RL-1530) Ser. No. 07/977,584, filed Nov. 17, 1992, now abandoned, and assigned to the same assignee of this patent application the use of a very hard surface anvil roll is disclosed having a hardness that will prevent excessive twist that is imposed in the strip. Such strip movement is some times hereinafter referred to as "tracking" or "wandering". In the first case, the misdirected or wandering strip causes the reduction of strip feeding speed and in some instances, interruption of the process and in the other, unwinding and handling difficulty in processing the scribes strip during the manufacture of the transformers.

A problem with the mechanical scribing equipment known in the art is the very small range of acceptable variations in the tolerance for domain refinement. Thermal transients resulting in thermal expansions of machinery parts and the roll elements impose erratic variations that are more acute when the silicon steel strip is scribed while heated for example, to a temperature greater than 1000° F. (540° C.). At an elevated temperature of the strip, the combination of relatively high loading pressures and temperature during scribing cause objectionable distortion and deflection of both the scribing roll and the anvil roll.

While the above prior attempts have to different degrees met the basic objectives to which they were addressed, they have created other technical and practical problems some of which the present invention is designed to overcome. The present invention provides a new method and apparatus for overcoming each of the above enumerated problems, difficulties and objections.

It is an object of the present invention to provide an apparatus and a method wherein scribing segments of a scribing roller used to refine the magnetic domain wall spacing of grain-oriented silicon steel strip are each acted upon in a manner to impose a uniform mechanical deformation across the width of the steel strip while supported by a solid body anvil roll.

SUMMARY OF THE PRESENT INVENTION

In accordance with the present invention, a method and apparatus is provided for refining the domain wall spacing of a grain-oriented silicon steel strip by mechanical scribing, wherein a scribing roll apparatus comprises an anvil roll means contacting one surface of the strip for support thereof, a segmented scribing roller means including segments having scribing surfaces for engaging a surface of the strip opposite the surface engaged by the anvil roll, the scribing roller means further including means resiliently supporting the segments for imposing a uniform mechanical deformation in a general direction transversely to the rolling direction of the strip by the scribing segments, and means for controlling the relative position the anvil roll means and the scribing roller means of the strip to establish a rolling pressure contact area wherein the strip is scribed.

The means resiliently supporting the segments of the scribing roller means include a controllable fluid pressure chamber for load bearing support for all scribing segments. The anvil roll means has a body for engaging the strip surface across the width thereof.

The method of the present invention provides the steps of subjecting the strip to be scribed to a rolling contact pressure area formed while the strip is moving between a segmented scribing roller means and a rotatable anvil roll means, and imposing a uniform mechanical deformation transversely of the strip within the rolling contact pressure area by resilient support of scribing roller segments each having a series of peripheral surface projections arranged such that upon rotation about the scribing roller means axis, the projections penetrate one surface of the strip independently of scribing surface projections on other segments while the strip is supported by the anvil roll means.

BRIEF DESCRIPTION OF THE DRAWINGS

The above objects and other objects and features of the invention will become more apparent from the following detail description taken in connection with the accompanied drawings which form a part of this specification and in which.

DETAILED DESCRIPTION OF THE PREFERRED EMBODIMENT

Figure 1:
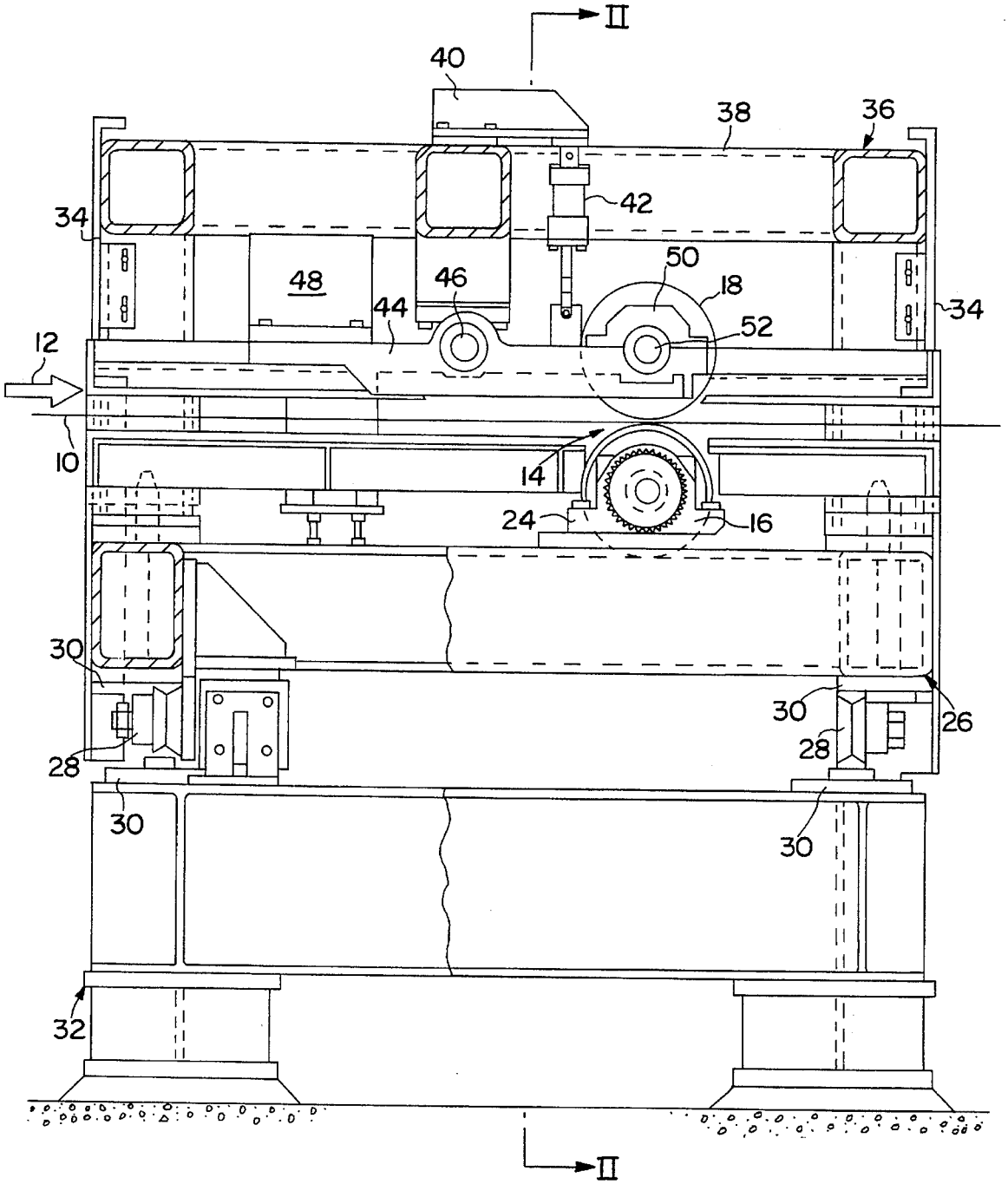
FIG. 1 is a side elevational view of a preferred embodiment of an apparatus which is useful to carry out the method of the present invention.
Figure 2:
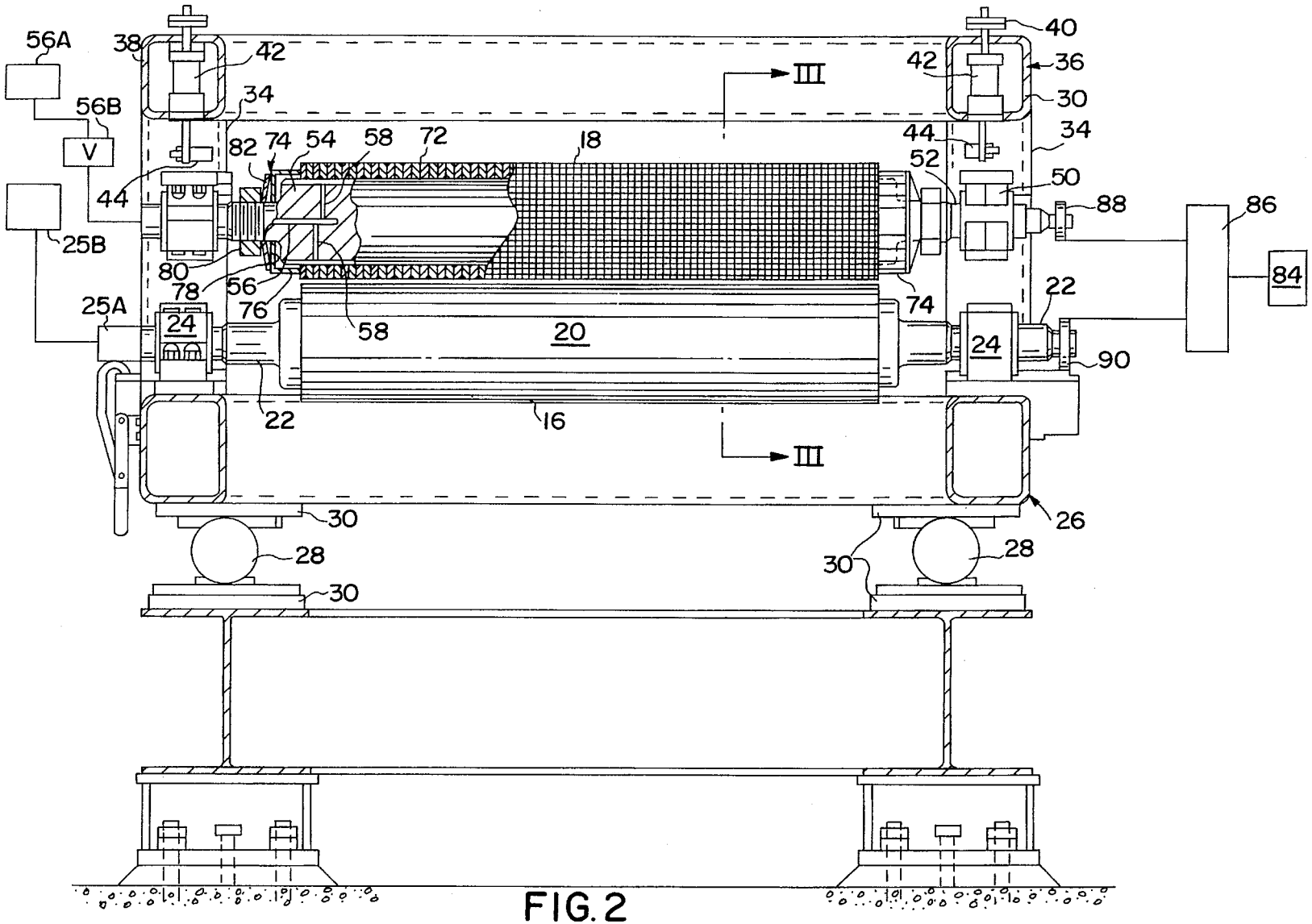
FIG. 2 is a sectional view taken along lines II—II of FIG. 1.

With reference to FIGS. 1 and 2, there is illustrated an apparatus for refining the magnetic domain wall spacing of electrical steels particularly grain-oriented silicon steel strip identified by reference numeral 10 by local mechanical deformation. The apparatus is useful for methods of scribing while the steel is relatively hot or cold but preferably, at an elevated temperature of at least about 1000° F. (540° C.), preferably at a temperature greater than 1200° F. (648° C.) carry out the method of the present invention. The strip is advanced along a pass line in a suitable well known manner from a payoff reel and after domain refinement by the present invention the strip is wound in a coil form by the mandrel of a coiler, of the kind also well known in the art. The method may be used in conjunction with other strip processing operations, when desired, without departing from the teaching of the present invention.

Figure 3:
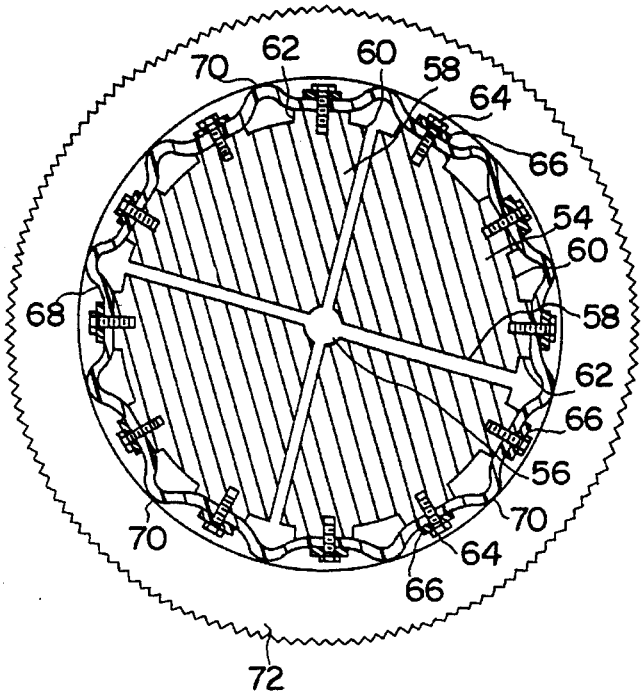
FIG. 3 is a sectional view taken along lines III—III of FIG. 2.

As best shown in FIG. 1, the strip advances along the pass line in the direction as indicated by arrow 12 for entry to a rolling contact pressure area 14 wherein the strip is simultaneously engaged at opposite sides by an anvil roll 16 and a segmented scribing roller 18. In the embodiment of FIGS. 1–3 the scribing roller 18 is above the strip and the anvil roll 16 is below the strip. This relation of the roll 16 and roller 18 to the opposite surfaces of the strip can be reversed without departing from the teachings of the present invention.

As shown in FIG. 2, the anvil roll has a strip engaging face surface on solid body 20 with journals 22 at its opposite ends each rotatably supported by an anti-friction bearing mounted in bearing block 24. The anvil roll and the scribing roller rotate about longitudinal axis extending along the length of the respective roll and roller. A fluid source such as water, 25B is supplied through a rotary coupling 25A to an internal bore in the anvil roll to minimize temperature excursions during the scribing operation. A rectangular sub-frame 26 supports the bearing blocks 24. The sub-frame 26 is positioned by rollers 28 engaged by upper and lower saddle plates 30 that establish the position of the sub-frame on a foundation base 32 (as shown in FIG. 1).

Upstanding corner posts 34 are supported by the sub-frame 26 and carry a rectangularly shaped top frame 36 of a welded construction using rectangular tubing. The top frame includes lengths of rectangular tubing 38 extending in a laterally spaced relation along opposite sides of the strip. A bracket 40 is carried by central part of each length of tubing 38 for support of a piston and cylinder assembly 42 at a site directly overlying a lever arm 44. Each piston and cylinder assembly 42 is secured by clevis mountings to a lever arm 44 and the bracket 40. As shown in FIG. 1, each lever arm 44 is pivotally supported by a centrally located pivot shaft 46 carried by a bearing block assembly for support by tubing 38. One end of each arm 44 is secured to a counter weight 48 while the opposite end of the arm supports a bearing block 50 for an anti-friction bearing that is mounted on a journal 52 extending from arbor 54 for rotatable support thereof and forming part of the scribing roller 18 (as shown in FIG. 2).

Figure 4:
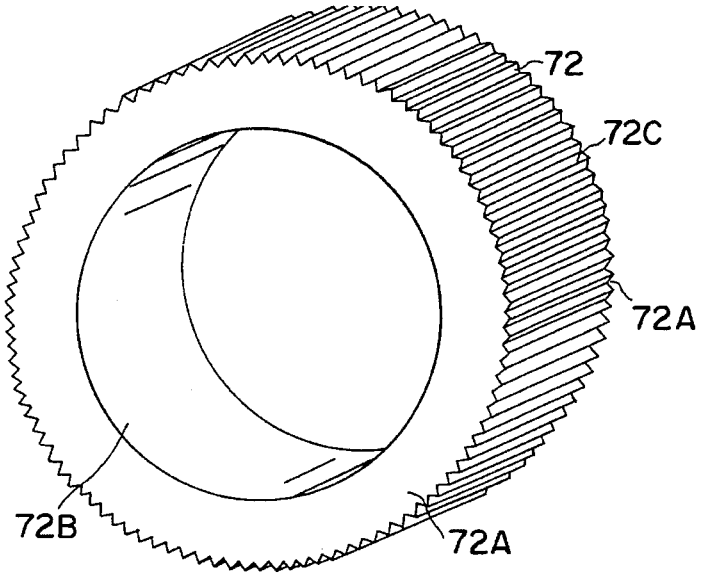
FIG. 4 is an isometric view of a segment forming part of a scribing roller of the present invention.

As best shown in FIGS. 2 and 3, a central bore 56 extends through each journal 52 and a short distance internally of the arbor 54 which is sufficient to establish a fluidic conducting relationship with radially extending bores 58. The external body of arbor 54 is provided along the entire length with longitudinally extending groves 60 that are formed by spaced apart interleaving raised ribs 62 about the entire periphery of the arbor 54. Bolts 64 passed through elongated keeper plates 66 threadedly engage each raised rib to clamp a strip like section of a tubular shaped flexible bladder 68 to the arbor. Rubber or other elastomeric materials are suitable materials to form the bladder. A pressurized source 56A of a fluid medium such as air or a liquid, which can be water, is controlled by a valve 56B supplied to the bore 56 for inflating the lengths of the bladder between the raised ribs of the arbor. The inflated parts of the bladder take the form of raised bladder ribs 70 protruding radially of the ribs of the arbor and form resilient support sites for scribing segments 72. The scribing segments, as best shown in FIGS. 3 and 4 each have a ring or disk-like configuration formed by parallel side walls 72A extending from a central opening defined by an annular bore 72B to an annular external outer peripheral face surface having radially protruding ridges 72C that are spaced apart to form scribed surfaces extending across the external face of the segment between the side walls 72A. Each segment rotates about the rotation axis of the scribing roller axis.

As shown in FIG. 2, the scribing segments are arranged in a side-by-side manner for support by the bladder ribs 70 along the face of the arbor. End fittings 74 each having a cylindrical support wall 76 joined to an end wall 78 press the mutually engaging side walls of the segments against one another under a force controlled by the torque applied to nut member 80 while threadedly engaged with suitably located threads on a portion of the journal 52. The clamping force applied to the scribing segments is predetermined and maintained substantially uniform by placing a spring-washer 82 between each end fitting 74 and nut member 80.

The scribing roller 18 and the anvil roll 16 are positioned relative to one another at opposite sides of the strip by operation of the piston and cylinder assembly 42 so that the scribing surfaces of the segments forming the scribing roller engage the strip in the rolling contact area to penetrate the surface of the strip with scribe markings to refine the magnetic domain wall spacing. As shown in FIG. 1, the weight of the scribing roller 18 is balanced about pivot 46 by counter weight 48 so that piston and cylinder assembly 42 can operate with extreme accuracy and relatively low hydraulic pressure to establish the contact area 14. The pressure in the rolling contact area is uniform across the width of the strip to maintain a critical tolerance to scribing pressure exerted by each disk due to the uniform pressure of support applied to each disk by the bladder. The clamping force between the side walls of the disk is not so great to preclude a desired relative position of the disks to accommodate crowning and changes to the crown of the anvil roll due to the temperature fluctuation of the anvil roll as was the scribing roller and the associated support structure. It is preferred to provide an internal passage for conductive coolant in the anvil roll to minimize thermal crown changes. Also, it is preferred to drive each of the scribing roller 18 and the anvil roll 16 to match the speed of the strip engaging surfaces with the line speed of the strip caused by the coiling mandrel or allied machine affecting the speed of the strip along the passline.

For this purpose, a suitable form of a drive includes a motor 84 coupled to a gear drive 86 having two output shafts each with a drive pinion on its outer end. One drive pinon meshes with a gear 88 secured to an extension of the journal 52 on one end of scribing roller 18. The other drive pinion meshes with a gear 90 secured to an extension of the journal 22 on one end of the anvil roll 16.

The magnetic domain wall refining according to the present invention, is accomplished within very demanding tolerances necessary to operate on the domain wall spacings, such as a pitch on the order of 5–15 mm. During start-up operations and continuous scribing operations, all inherent thermal transients and expansion of machinery parts resulting therefrom, particularly when the steel strip is hot, are accommodated by the scribing apparatus of the present invention since the resilient support for the scribing segments can be relied upon to impose mechanical deformations transversely across the strip while advanced along the pass line. The scribed pattern on each scribe segment can be created with great precision and significant savings to the required grinding machinery because the scribing segments can be made of a much smaller diameter and/or width than that required for a one-piece body scribing roll. Since the scribing roller is segmented, a solid body anvil roll can be used which solves many existing problems including deflections caused by thermal transients. Less costly investment for equipment is required for regrinding the scribing pattern on the scribing segments. Also, the scribing segments can be made according to less costly methods and enable the use of more suitable materials. Since the anvil roll is not required to deflect to conform to the contour of the scribing roller, the anvil roll can be made of a harder and more heat resistant material. The scribing roller arrangement provides great versatility for the setup operation wherein the bladder of the scribing roller can be collapsed and the scribing segments changed quickly. The discs and the associated parts are small and light-weight to such an extent that they can be easily manipulated by workmen without the need of a crane.

Figure 5:
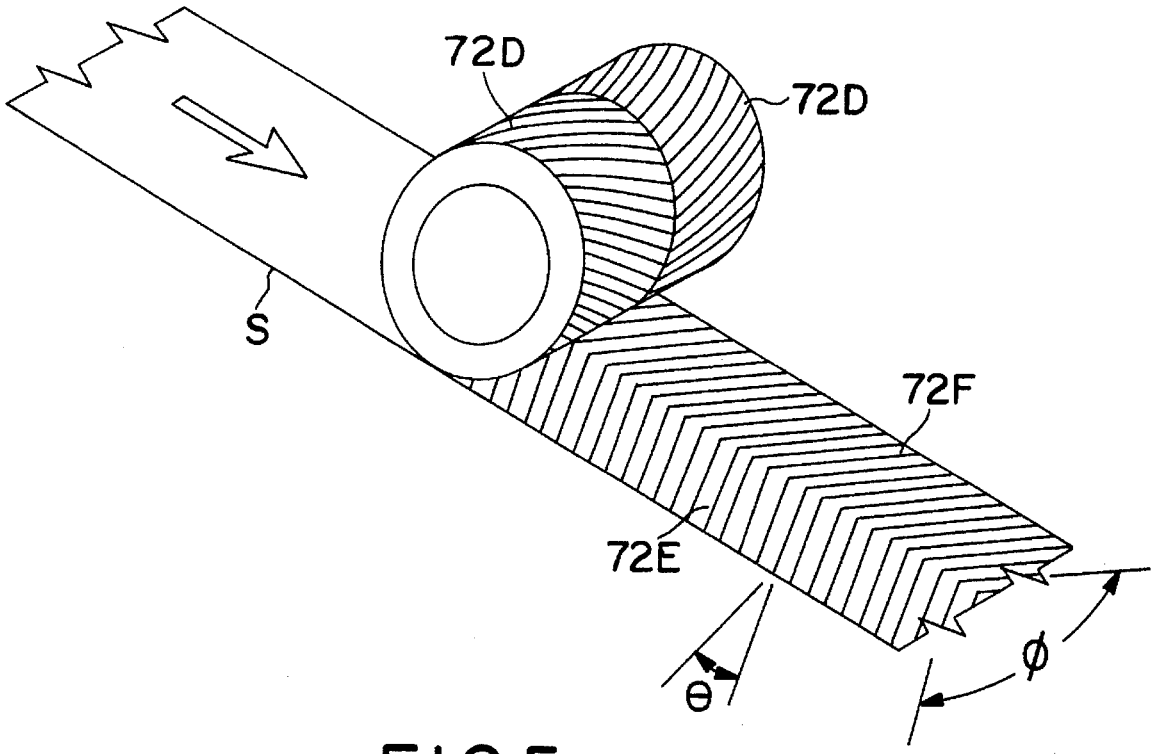
FIG. 5 is an isometric view of a preferred arrangement of scribing surfaces on adjacent scribing roller segments.

In FIG. 5 there is illustrated a preferred embodiment of the arrangement of ridges protruding from side-by-side segments of the segmented scribing roller according to the present invention. As can be seen, the scribing roller segments have an outer face surface that is annular and defines a helical arrangement of scribing ridges 72D spaced apart between 1 and 15 mm, preferably between 2 and 12 mm and extending across the face surface of each of the scribing segments. The spacing or pitch of the scribing ridges as measured between the valleys or grooves scribed defining two adjacent projections may be on the order of 2 to 12 mm, preferably about 5 to 10 mm, and have a depth on the order of 0.5 to 1.0 mil (0.0005 to 0.0010 inch). The lead of the helix formed by each scribing surface 72D is 45° or less and can have a lead angle between 10° to 20°. As shown in FIG. 5, the helical arrangement of ridges formed by the side-by-side arrangement of the scribing segments produce on the surface of the strip as a result of the scribing operation pattern, scribed lines 72E and 72F that are angled at an angle $\theta$ of 45° or less preferably between 20° and 10° from the perpendicular to the strip rolling direction shown by the arrow in FIG. 5. Also shown in FIG. 5 is the arrangement of the scribed marks caused by the adjacent patterns on segments forming an included angle of $\phi$ of at least 90° preferably in the range of 90° to 160° and forming a chevron pattern of scribe lines on the strip across the entire width of the strip.

Figure 6:
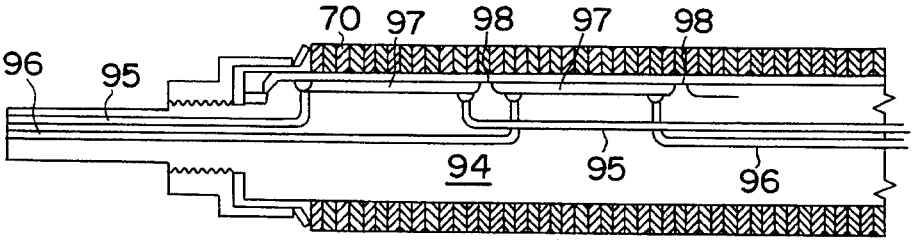
FIG. 6 is a partial sectional view illustrating internal passageways for pressurizing and cooling a scribing roller according to a modified embodiment of the present invention.

In FIG. 6 there is illustrated a modified form of an arbor, identified by reference numeral 94, and used in the scribing roller in lieu of arbor 54 described hereinbefore. The construction of arbor 94 differs from the construction of arbor 54 by the inclusion of a multiplicity of pairs of bores 95 and 96 that are spaced apart and extend in a direction parallel with the rotational axes for supply and discharge of fluid medium to individual cavities 97. These cavities are formed by partitioning walls 98 that subdivide each groove 60 and allow control of the pressure in bellows spacing the area between the adjacent partitioned walls raised ribs 62 by varying the pressure by which individual groups of scribing segments 72 are supported along the length of the arbor 94. Also as shown in FIG. 6 are a multiplicity of bores 95 and 96 angularly arranged in pairs with other such bores to remain discrete for controlling the support pressure for the segments. By this arrangement and the use of the multiple rotating fluid coupling joints, fluid may be circulated through the various bores for cooling. The inlet pressure for one of the bores in each pair can be controlled to exceed the outlet pressure to provide a pressure and thereby create a pressure differential by which the individual bladder support area responds by expansion and support of scribing segments in contact therewith.

Figure 7:
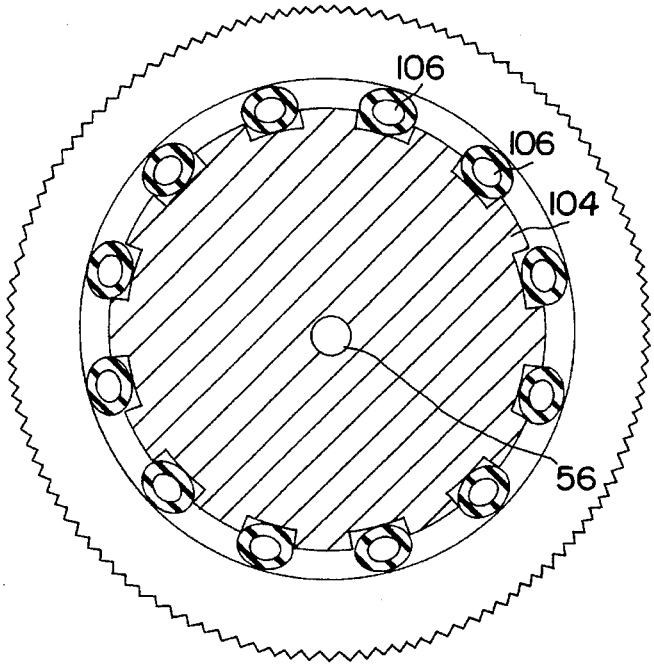
FIG. 7 is a sectional view similar to FIG. 3 and illustrating a modified form of support bladder for the segments of a scribing roller.

As shown in FIG. 7 a further embodiment for the resilient support for the scribing segments is shown wherein an arbor 104 differs from the construction of arbor 54 (of FIG. 2) by the elimination of serpentine arrangement of a bladder web. The arbor 104 may have a cylindrical outer surface or have partitioning ribs to form pockets on which there is arranged an array of parallel extending hose bladders 106 in a side-by-side relation to extend along the length of the arbor. The hose bladders 106 are joined by fittings to radially extending bores (corresponding to bores 58) at opposite ends of the arbor for the supply of a fluid medium to each hose bladder. Pressure exerted by the hose bladder 106 serves to support the scribing segments so as to enable the scribing segments to exert an uniform pressure on the strip across the width thereof during scribing.

Figure 8:
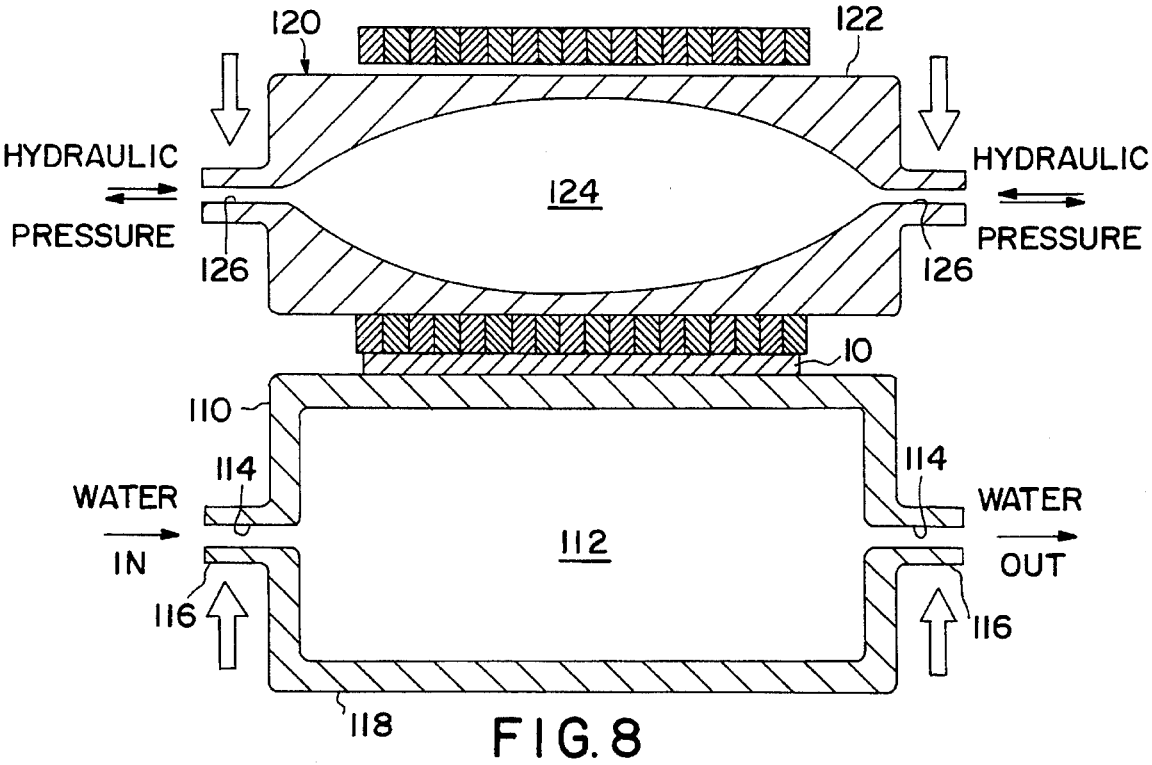
FIG. 8 is an elevational view in section illustrating a further embodiment of an apparatus useful to carry out the method of the present invention.

In FIG. 8 there is illustrated a further embodiment of apparatus suitable to carry out the method of the present invention in which only the construction of the anvil roll and the scribing roller differ from the construction described hereinbefore in regard to the embodiment described in FIGS. 1–4. The anvil roll 110 has a solid body with an internal cavity 112 communicating with a duct 114 in the journals 116 at each end of the roll body 118 for the supply and discharge of a coolant medium such as water. The scribing roller 120 includes an arbor having a solid body 122 with an internal cavity 124 communicating with ducts 126 extending in journals at opposites ends of the roll body for creating a controlled hydraulic pressure in the cavity 124 whereby the contour of the roll body 122 at its outer cylindrical body surface can be controlled. When the hydraulic pressure in the internal cavity is increased, the contact pressure with the segmented scribing rings is increased to compensate for contour changes to the anvil roll and allied support structure during the domain refinement process. In this way the arbor and the scribing roll compensate for thermal crowning through expansion and contraction of the arbor with the scribing rings being supported in a non-concentric fashion so as to allow vertical relative movement between the segment coincident with expansion or contraction of the arbor.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

We claim:

1. A method for refining the magnetic domain wall spacing of a grain-oriented silicon steel strip, said method including the steps of:

subjecting the strip to be scribed to a rolling contact pressure area formed while the strip is moving between a segmented scribing roller means and a rotatable anvil roll means; and imposing a uniform mechanical deformation transversely of said strip within said rolling contact pressure area by resilient support of scribing roller means segments clamped side-by-side and each having a series of outer peripheral surface projections arranged such that upon rotation about a rotational axis of the scribing roller means, the surface projections penetrate one surface of the strip independently of other scribing surface projections on other segments while the strip is supported by said anvil roll means.

2. The method according to claim 1 wherein said uniform mechanical deformation is imparted across the width of the strip while supported by said anvil roll means.

3. The method according to claim 1 including the further step of supporting said scribing roller means segments with a constant pressure across the width of the strip.

4. The method according to claim 1 including the further step of supporting individual groups of said scribing roller means segments by an independently controlled resilient support.

5. The method according to claim 1 including the further step of driving said scribing roller means and said anvil roll means.

6. The method according to claim 1 including the further step of positioning said scribing roller means relative to said anvil roll means to establish said rolling pressure contact area.

7. The method according to claim 6 including the further step of pressing side walls of said scribing segments into contact with one another under a substantially uniform pressure while the segments are resiliently supported.

* * * * *